United States Patent [19]

Cooper

[11] Patent Number: 4,582,372

[45] Date of Patent: Apr. 15, 1986

[54] BI-AXIAL SHELF WITH RETRACTABLE GUIDANCE AND SUPPORT SYSTEM

[76] Inventor: William E. Cooper, 5000 W. Leyburn Ct., Richmond, Va. 23228

[21] Appl. No.: 384,905

[22] Filed: Jun. 4, 1982

[51] Int. Cl.[4] ..... A47B 88/10

[52] U.S. Cl. ..... 312/322; 108/140; 108/143; 312/238; 312/307

[58] Field of Search ..... 108/137, 140, 143, 102; 312/322, 323, 307, 282, 238, 132, 305

[56] References Cited

U.S. PATENT DOCUMENTS

| | | | |
|---|---|---|---|
| 278,152 | 5/1883 | Larson | 312/322 |
| 330,409 | 11/1885 | Larson | 312/322 |
| 379,232 | 3/1888 | Larson | 312/322 |
| 535,886 | 3/1895 | Brand | 312/322 |
| 556,707 | 3/1896 | Strahan | 312/322 UX |
| 2,104,939 | 1/1938 | Whalen | 312/322 |
| 2,293,496 | 8/1942 | Egger | 108/140 |
| 2,547,083 | 4/1951 | Lundgren | 312/323 X |
| 2,573,496 | 10/1951 | Runkle | 312/322 |
| 2,650,871 | 9/1953 | Holderegger | 312/322 |
| 4,124,262 | 11/1978 | Schill | 312/305 |

*Primary Examiner*—William E. Lyddane
*Assistant Examiner*—Thomas A. Rendos

[57] ABSTRACT

A full length, partially rimmed, interior shelf of a corner base cabinet is so shaped and controlled that it makes a 90° turn as it is drawn out through the cabinet door on a retractable guidance and support system to an extended position where it can be readily loaded or unloaded and returned to its original position.

14 Claims, 20 Drawing Figures

Fig. 5
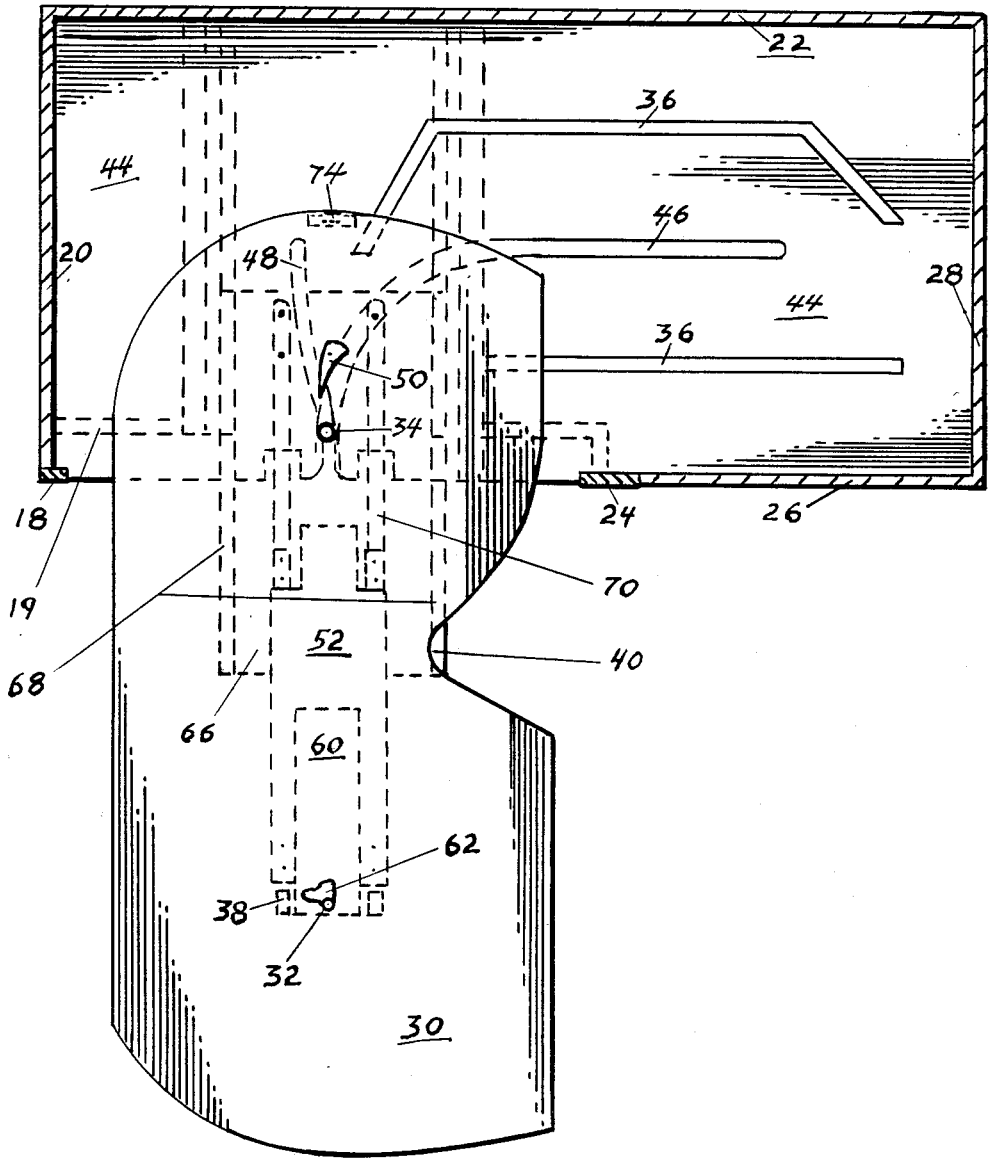
Fig. 6A
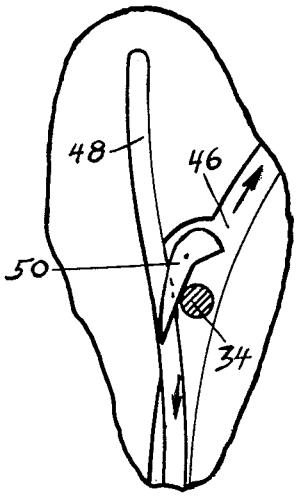
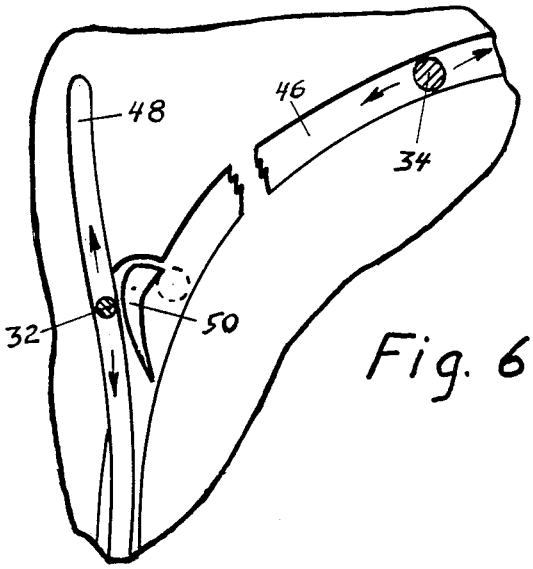
Fig. 6B

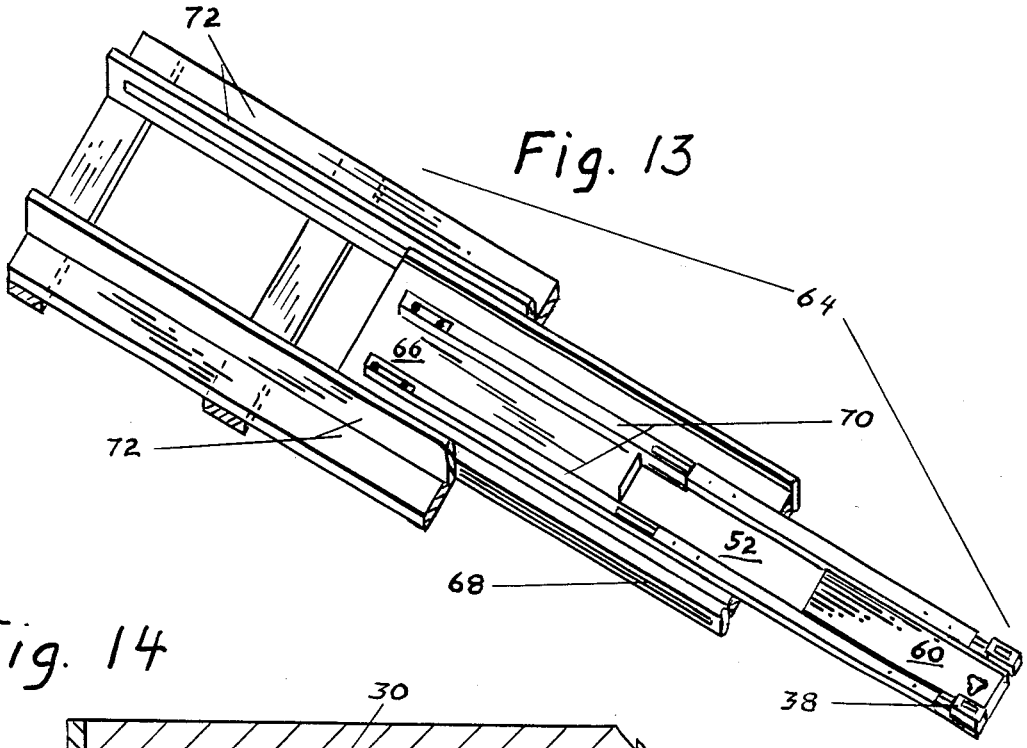
Fig. 13
Fig. 14
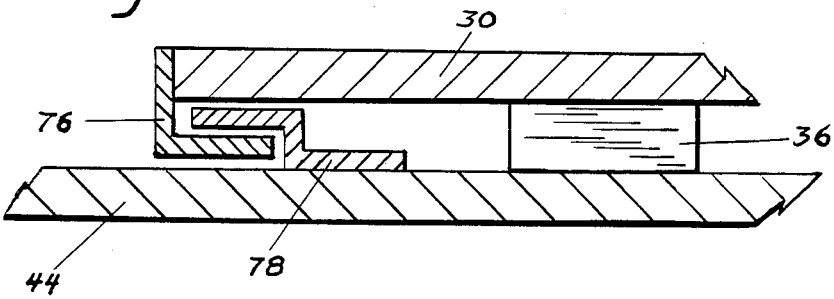
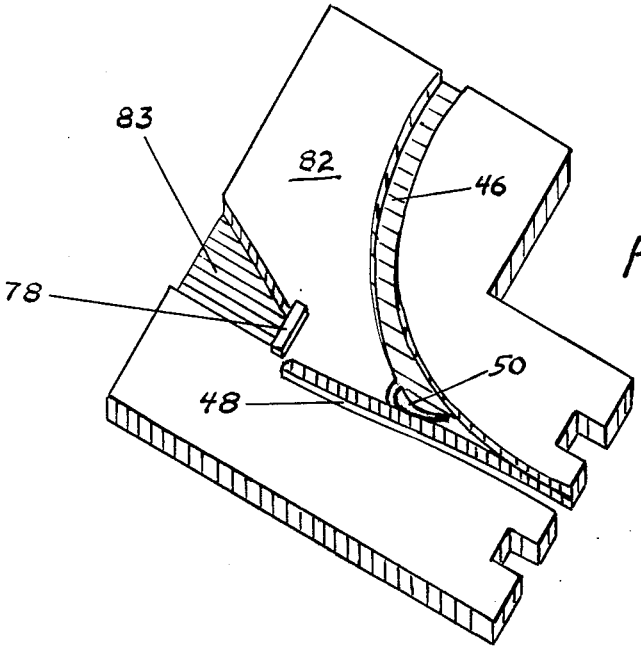
Fig. 15

BI-AXIAL SHELF WITH RETRACTABLE GUIDANCE AND SUPPORT SYSTEM

BACKGROUND OF THE INVENTION

There has been a long-standing problem of how to provide convenient access to the blind or dead-end storage space of corner base cabinets, whose more remote indirect access areas usually can only be reached by getting on hands and knees. The well-known Lazy Susan revolving shelf provides a partial solution, but it has limitations in terms of space efficiency and lack of simultaneous access to everything on the shelf. The half-circle or 180-degree shelf is even less space efficient, and only about half the items so stored are readily reachable. The invention herewith submitted offers a superior alternative to solving the problem for it provides greater space efficiency than do the others along with full and simultaneous visual and reachable access to all stored items.

SUMMARY OF THE INVENTION

The present invention is a partially rotatable and slideable shelf which differs from the Lazy Susan or half-circle shelves in that it does not have a fixed pivot. Instead, it has two separate non-stationary axes—one each for the forward and rear halves of the shelf. These axes protrude from the underside of the shelf, and operate in cuts made into and/or through the baseboard of the cabinet primarily along its longitudinal and transversal centerlines. These cuts control and direct the movement of the two ends of the shelf, which is so shaped that it makes a right-angle turn as it emerges from and returns into the cabinet. It is this cornering characteristic that enables the shelf to provide easy access into and egress from otherwise hard to reach storage areas.

In operation, the shelf is moved laterally and rotated in and out of the cabinet by sliding over bearings or non-friction strips. In its fully extended position, from two-thirds to three-fourths of the length of the shelf extends out from the cabinet for unobstructed loading or unloading. In this extended position, the shelf is guided and supported by a telescoping, partially cantilevered mechanism operating from under the baseboard. Support is further aided by an anchoring device which prevents the rear end of the shelf from tilting upwards when the front end is heavily loaded, and by a set of dolly-type wheels fastened to the underside of the mechanism which carries much of the load, thereby reducing the strain on the cantilevered extension.

BRIEF DESCRIPTION OF THE DRAWINGS

The accompanying figures schematically illustrate the present preferred embodiment of the invention:

FIG. 5: Top view showing fully extended shelf positioned over its guidance and support system.

FIG. 6: Enlarged break-away view A and B of traffic control switch for front and rear axes.

FIG. 13: Perspective view of double telescoping support system in its extended position.

FIG. 14: Enlarged side view of anchoring device.

FIG. 15: Perspective view of pre-cut and assembled guide plate.

DETAILED DESCRIPTION OF THE PREFERRED EMBODIMENT

Figure 1:
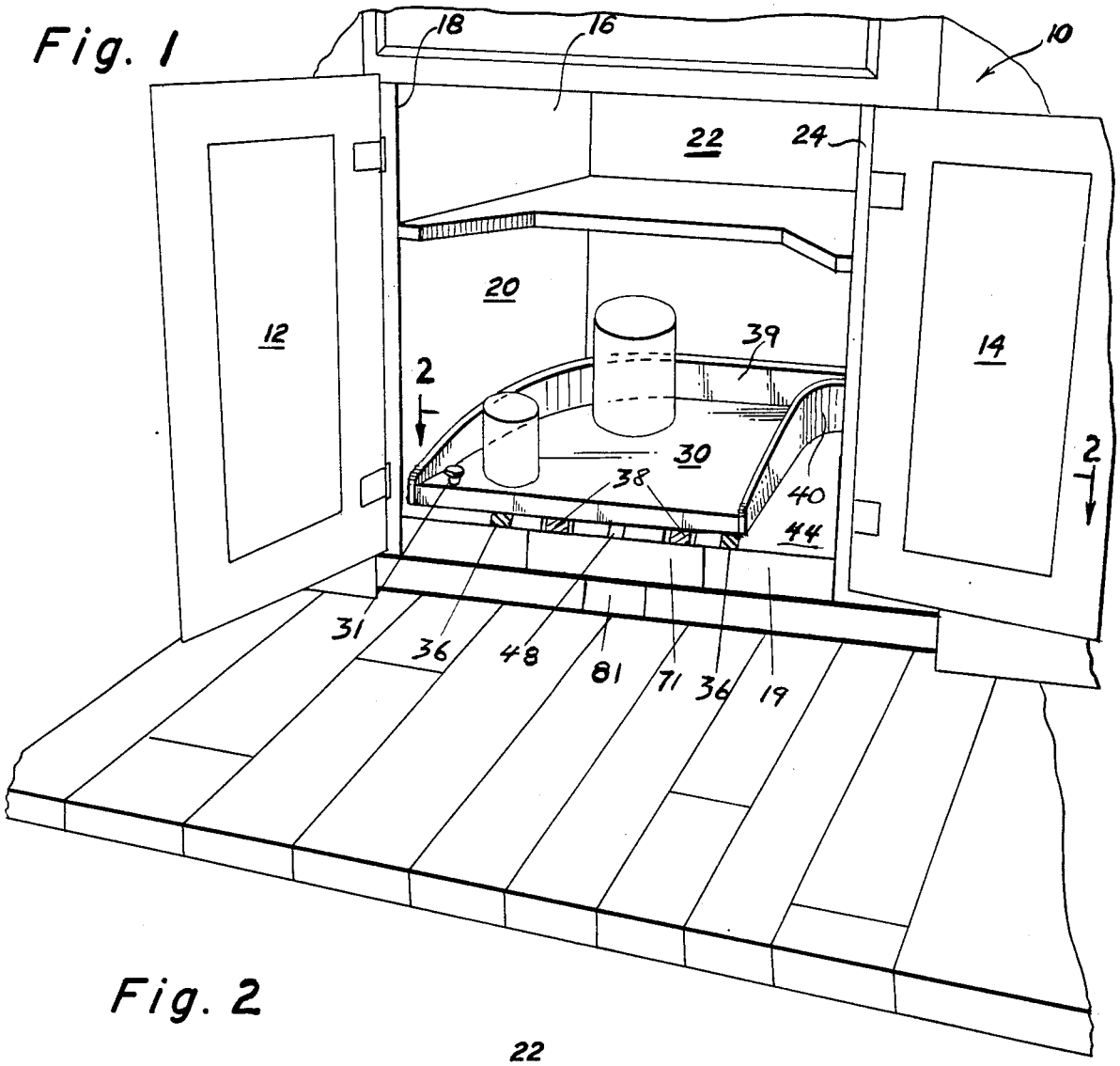
FIG. 1: Perspective front end view of bi-axial shelf in its recessed position in a corner base cabinet.
Figure 2:
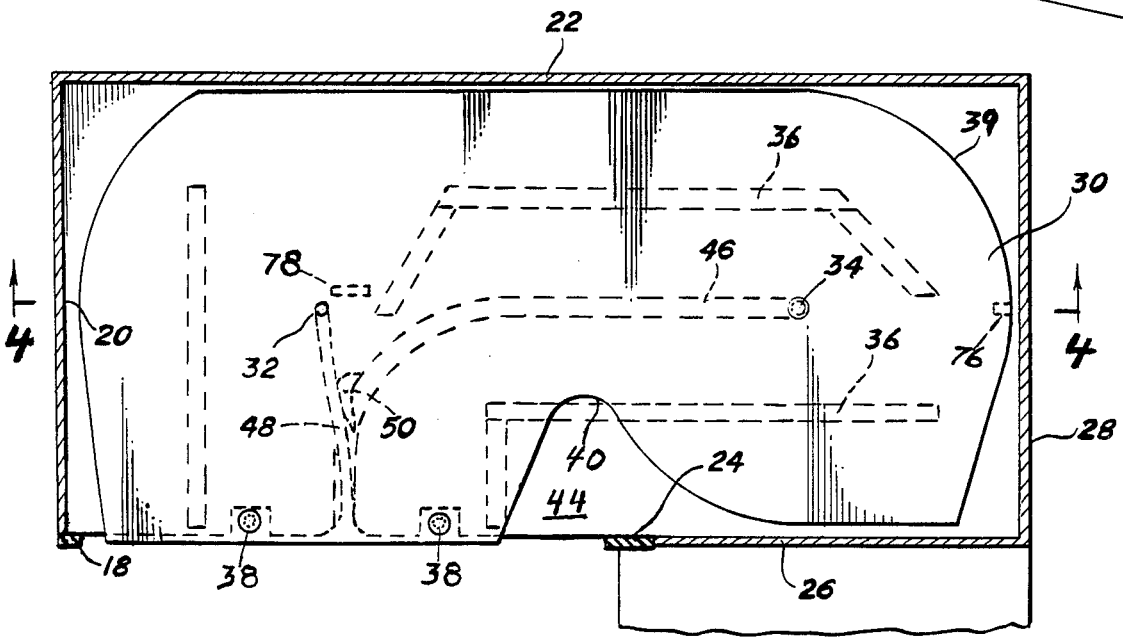
FIG. 2: Top view showing recessed shelf positioned over the cabinet base with its guide and support features.

Referring now more particularly to the drawings and initially to FIGS. 1 and 2, there is shown a cabinet 10 having a pair of doors 12 and 14 controlling access to an opening 16. The door 12 is hinged on a door stile 18, and a cabinet sidewall 20 extends between stile 18 and the rear cabinet wall 22. The door 14 is hinged on door stile 24, and the front cabinet wall 26 extends from that door stile 24 to the other cabinet sidewall 28. The space enclosed by the cabinet walls 26, 24 and that portion of rear wall 22 opposite to wall 26 cannot be reached directly but only indirectly through the door opening 16 and the other portion of the cabinet that fronts on it. Hence the term "blind corner" or "dead end" is often used to describe such a corner base cabinet.

Figure 3:
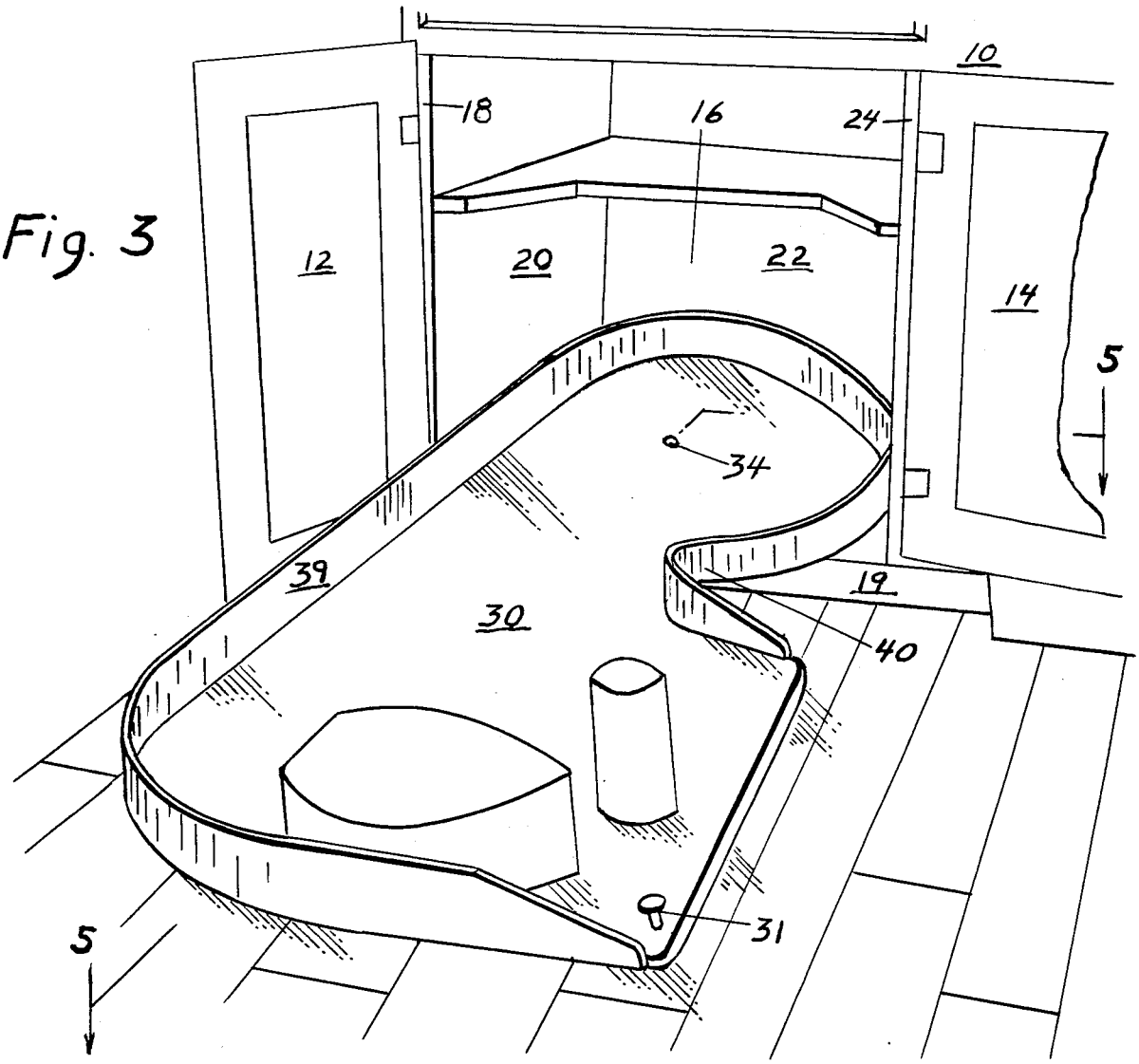
FIG. 3: Perspective view of cabinet and shelf in its extended position.
Figure 8:
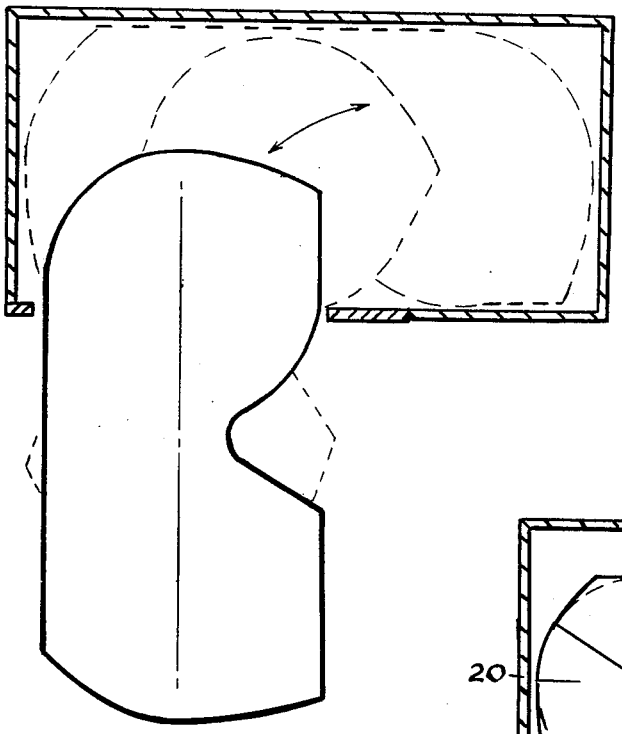
FIG. 8: Positions of shelf as it is moved in an out of cabinet.

The cabinet 10 contains a partially rimmed shelf 30 so shaped and guided and supported that, from a fully recessed position, as shown in FIGS. 1, 2 and 8, it can be drawn out of the cabinet to a fully extended position, as shown in FIGS. 3, 5 and 8, from whence it can once again be moved back into the cabinet.

THE SHELF AND ITS DESIGN

Figure 7:
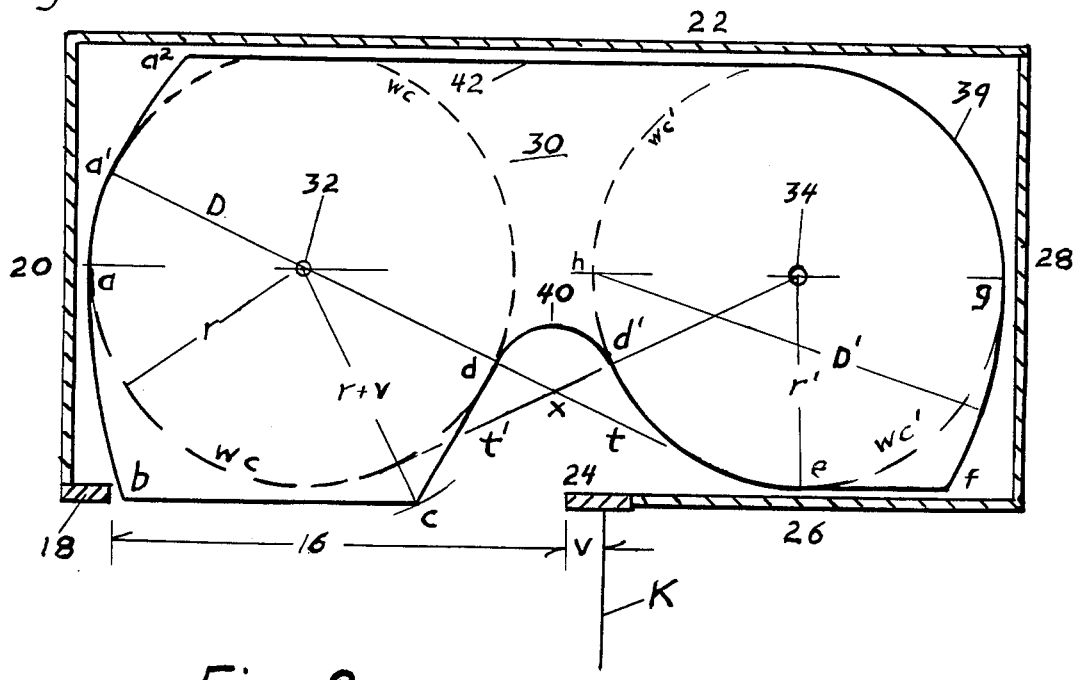
FIG. 7: Basic design of the bi-axial shelf, with modifications to achieve the maximum storage area possible.

The bi-axial shelf 30 is fashioned from a sheet of plywood, composition board, or other material that is as wide and as long as the inside measurements of the cabinet in which it is to function. As the name implies, the shelf has two axes—one for each end—which control the rotating and sliding movements of the shelf. Where these axes are located, and other details of the basic shelf design, are shown in FIG. 7. Details are as follows:

1. The front axis 32 is located at a point on the longitudinal centerline of the shelf 30 a distance from the inside cabinet wall 20 equal to one-half the width of the door opening 16.
2. The rear axis 34 is located at a point on the longitudinal centerline equidistant from sides 22 and 26 and end wall 28.

Figure 9:
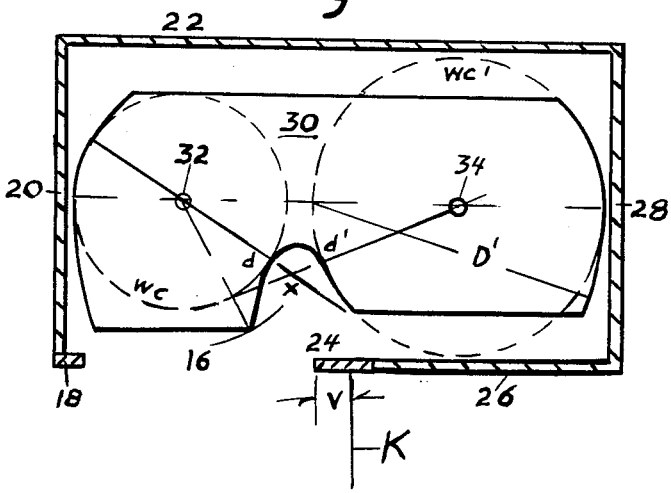
FIG. 9: Shelf design for cabinet whose door opening is narrower than the inside depth of the cabinet.
Figure 10:
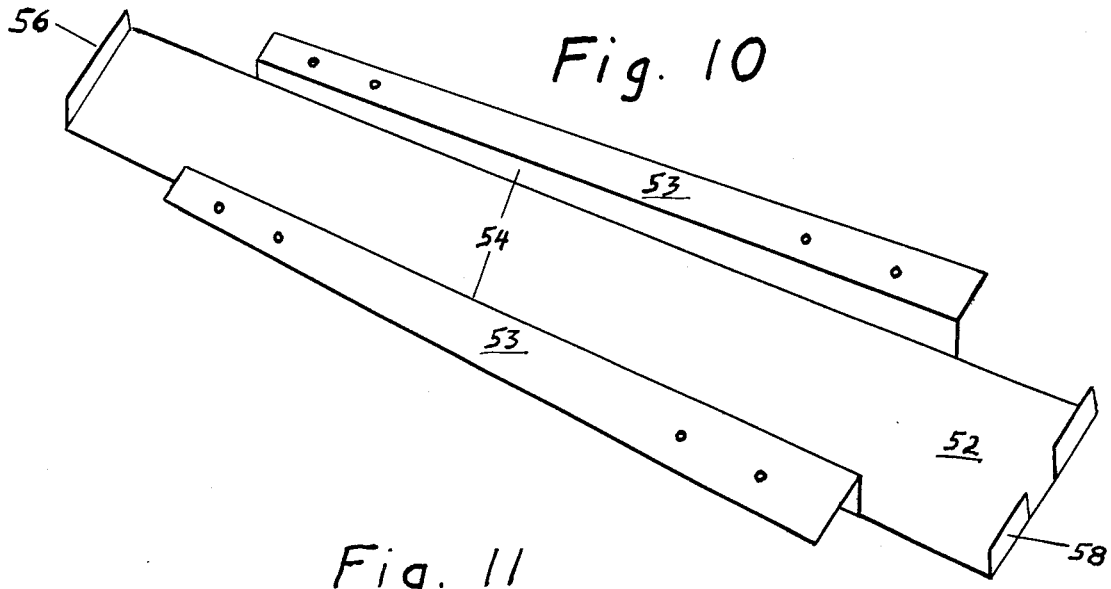
FIG. 10: The trough, which controls the transverse movement of the shuttle both within and outside the cabinet.
Figure 11:
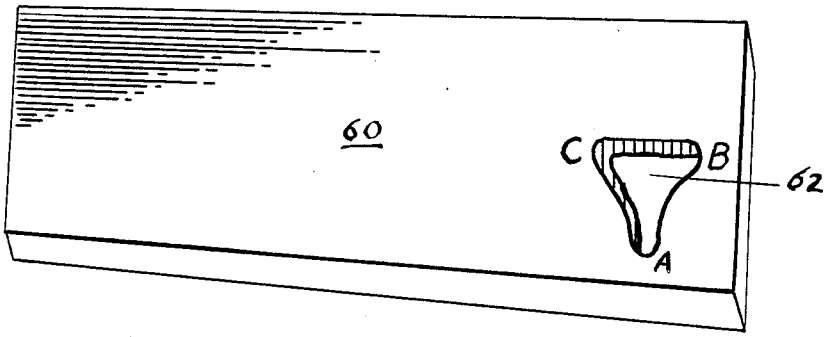
FIG. 11: The shuttle, which is the linkage between movement of the shelf and the guidance and support system.

3. Working circles wc and wc' are then drawn from these two axes 32 and 34 using radii r and r' equal to the distance to the respective end walls 20 and 28 less a clearance allowance of $\frac{1}{4}$ inch more or less to prevent binding.
4. Once working circles wc and wc' are drawn, a tangential line t is extended from the front axis 32 to the lower circumference of the rear axial working circle wc' as shown, and a similar line t' is extended from the rear axis 34 to the lower circumference of the front axial working circle wc as shown. Where the two tangential lines t and t' cross at point x, and when the two working circles have the same diameter, a simple turning arc 40 is drawn between points d and d' using a radius equal to dx. If the two working circles are unequal in diameter, which can be caused by a larger or smaller door opening (See FIG. 9), the point x will be off center between the two working circles, and an eccentric turning arc 40 must be drawn from it with radii varying from dx to d'x to connect the two working circles.
5. On the opposite or back edge of the shelf 30, the two working circles wc and wc' are connected by a line 42 paralleling the rear wall 22 of the cabinet but distant from it the aforementioned $\frac{1}{4}$ inch more or less clearance allowance.

The above five steps establish the basic design of the bi-axial shelf 30. They represent a procedure or process that can be applied to any given blind corner type cabinet regardless of width or depth or size of door opening. But additions to the basic design can be made in certain quadrants of the working circles to provide even greater storage space without interfering with the shelf movement. Those additions are:

6. The radius of the arc $a'a^2$ on the upper front half of the shelf is centered at point x, and equals the diameter D of working circle wc plus the radius dx of the turning arc 40. Once arc $a^1 a^2$ is established point $a^2$ is connected to point $a^3$ by a straight line. This is the maximum possible width that can pass through the door opening 16 as the shelf 30 is extended and/or recessed.
7. The radius of the arc ab on the lower front half of the shelf 30 must be from a point on the longitudinal centerline not less than the distance to the rear axis 34; for, in the extension of the shelf 30 from the cabinet, the first movement is a rotating one centered at the rear axis 34. Conversely, the inside width of the door stile 18 must be such that it does not encroach on this minimum arc. However, the radius of the arc ab can be greater to match a narrower stile 18. If there is no stile, ab is a straight line paralleling endwall 20 of the cabinet.
8. The front edge bc of the shelf 30 parallels the inside line of cabinet doors 12 and 14 when they are closed, with c being located at the intersection with that line of a radial line from the front axis 32 equal to the radius r of the working circle wc plus the external variable v. This latter represents the clearance between a perpendicular line extending out from the edge of door stile 24 and the front line of any adjoining cabinet, appliance or other obstruction K. Once c has been established, it is connected to the turning arc 40 at point d by a straight line.
9. The arc fg on the lower rear half of the shelf 30 is also affected by the inside width of the door stile 18. In general, the radius of arc fg should be centered at point h on the longitudinal centerline and should be equal to the diameter D' of the rear axial working circle wc'. However, this fg radius may be shortened or lengthened to meet the rotation requirements brought on by a wider or narrower door stile 18. Point f thus is the intersection of the arc gf with a tangential line ef from working circle wc' parallel to the front wall 26 of the cabinet.
10. For cabinets with a door opening less in width than the inside depth of end walls 20 and 28, the preceding nine steps are followed in their entirety. Additionally, however, the rear axial working circle wc' must be truncated equally on both its front and back sides so that its width is the same as the diameter of the front axial working circle wc. (See FIG. 9) The shelf then has the maximum area that can be moved in and out of the narrow door.

Taken together, the basic design plus applicable additions as detailed above will produce a bi-axial shelf whose perimeter encompasses the maximum possible storage area that can be rotated in and out of any given corner base cabinet, regardless of variations in door or cabinet widths.

THE GUIDANCE SYSTEM

The bi-axial guidance system enables the shelf 30 to be moved laterally and rotated 90 degrees from a fully recessed to a fully extended position and returned back into the cabinet (FIG. 8), being kept under control at all times so that it does not rub or scrape against the door stiles or the sides or ends of the cabinet.

A basic feature of the system is a pair of axes 32 and 34, one each for the forward and rear halves of the shelf 30, which are located as previously described, and which protrude from the underside of the shelf 30 so as to be engaged in a slot 48 and a flat-bottomed groove 46 cut through and/or routed into the baseboard 44 of the cabinet 10. Both axes are in the form of nylon rods, with the front axis 32 being $\frac{1}{2}$ inch in diameter and about 3 inches in length, and the rear axis 34 being $\frac{3}{4}$ inch in diameter and about $1\frac{1}{2}$ inches in length. Both the slot 48 and the groove 46 in which the axes move must be slightly larger in width than the diameter of the respective rods so as to prevent binding.

The groove 46 for the rear axis 34, or provision for such a groove, begins in the baseboard 44 of the cabinet corresponding to the location of the rear axis 34 when the shelf 30 is in its recessed position (FIGS. 2 and 5). From that point it is cut along the longitudinal centerline of the baseboard 44 until it reaches a point beyond the inner door stile 24, where it begins a 90-degree curve to the transversal centerline of the door opening 16, from which point it follows that centerline to the front of the cabinet. In a one-half inch thick baseboard 44, the groove 46 would be approximately half that depth; and the curve connecting the two centerlines would have a radius of less than one-half the width of the door opening 16. This groove 46 controls the lateral movement of the rear half of the shelf 30, and permits any necessary rotation when the shelf 30 makes its 90-degree turn as it approaches the door opening 16. In its normal movement, the rear axis 34 never leaves the confines of the cabinet 10.

The slot 48 for the front axis 32 begins at the location of the front axis 32 on the longitudinal centerline when the shelf 30 is in its recessed position. If there is no door stile 18, the slot 48 would be cut in a straight line down the transversal centerline to the door opening 16. However, if there is a door stile 18, as is true for most cabinets, the door opening and its centerline will have been shifted sideways away from wall 20 a distance equal to the inside width of the stile. Thus, the slot must begin off-center from the transversal centerline through the door the same distance as the inside width of the door stile 18. It then is cut completely through the baseboard 44 with the cut continuing towards the front of the cabinet 10 in an arc whose radius must be not less than the distance between the two axes 32 and 34. When the slot intersects the transversal centerline, it then follows that line to the front of the cabinet. This slot 48 controls the movement of the front half of the shelf 30 only so long as the front axis 32 remains within the confines of the cabinet 10.

It should be noted that both slot 48 and groove 46 utilize the lower portion of the transversal centerline; but, in the return movement of the shelf 30, neither axis will ever go the wrong way because of their differing diameters and lengths. However, since a portion of one side wall of the groove 46 is missing at its intersection with the slot 48, a smooth, non-jarring movement past that point by the rear axis 34, both coming and going, is attained by the installation of a switching device 50 (See FIGS. 2 and 5). In FIG. 5, when the shelf 30 is moved back into the cabinet from a fully extended position, its rear axis 34 approaches the traffic control switch 50 as shown in 6A and is shunted away from slot 48 into the groove 46 by the elongated tail of the switch 50 as it rests against the sidewall of the slot 48. As the rear axis 34 moves on, it pushes the lobed portion of the switch 50 into the recessed area as shown in 6B and then goes on to its farthest recessed position in groove 46. This movement also provides unobstructed passage for the front axis 32 as it moves upward to its recessed position at the top of the slot 48. In reverse action, as the shelf 30 is moved out from the cabinet, the front axis 32 is pulled down its unobstructed slot 48, and the rear axis 34 follows in the groove 46 and pushes the tail of the switch 50 from its position as shown in 6B back to where it was in 6A.

It also should be noted that once the front axis 32 leaves the confines of the cabinet 10, it requires another means of keeping the shelf 30 under control while it is in an extended position outside the cabinet 10. A combination of shuttle and trough work in conjunction with the support system to provide this control (See FIGS. 5, 10, 11, 12, 13 and 17).

The trough 52 is a shallow, flat-bottomed, sheet metal object (FIG. 10) with flanges 53 on two sides by which it will be attached to the bottom-mount metal slides 70 of the support system. The length of the trough 52 is approximately the same length as the metal slides 70, and the depth of its channel 54 is slightly less than the thickness of the slides 70 so as to eliminate dragging as they are moved. Each end of the flat bottom of this channel 54 is turned up at right angles to form stops 56 and 58 for the shuttle 60 that will move back and forth in it.

The shuttle 60 is a wooden device (FIG. 11) with a width slightly less than the channel 54 of the trough 52 so it can move without binding, and with a thickness approximately the same as the channel 54 depth. Its length normally is somewhat more than half the length of the trough 52. Near one end of this shuttle 60 is a triangular-shaped cutout 62 which will receive the projecting front axial rod 32 of the shelf 30. The base of this triangular opening 62 is cut along the shuttle centerline, and its apex is off-center from the shuttle centerline the same distance as the inside width of the door stile 18. It should be noted that the 3½ inch wide shuttle 60 can be used for either left-hand or right-hand door cabinets merely by flipping it over sideways; for, in either case, its centerline matches the centerline of the trough.

Figure 12A:
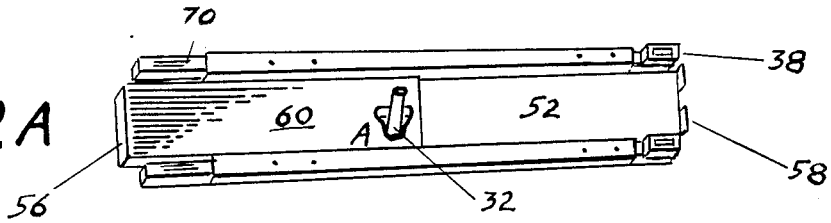
FIG. 12: Relationship of axis and shuttle in views A and B as they activate the support system.
Figure 12B:
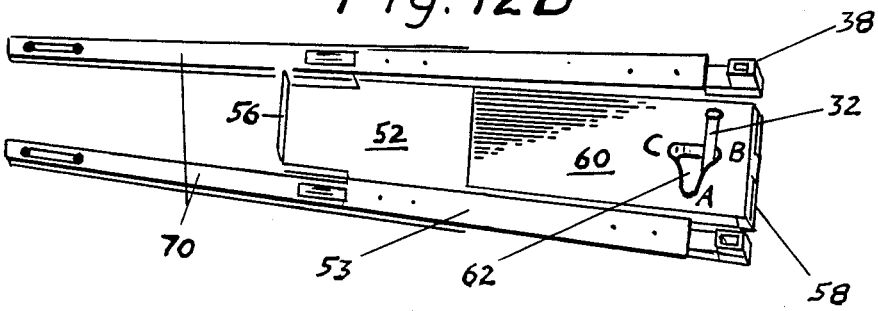

When installed with the support system 64, the centerlines of the trough 52 and the shuttle 60 must be aligned with the transversal centerline through the door opening 16 of the cabinet 10. Also, the apex of the shuttle cut-out 62 will be positioned at a point along the longitudinal centerline of the cabinet. Thus, when the shelf 30 is fully recessed, its front axis 32 will be couched in the apex of this shuttle cutout 62 at Point A of FIG. 12A. As the shelf 30 is drawn towards the door opening 16, the slot 48 in the baseboard 44 guides the front axis 32 over to the transversal centerline. As the shelf 30 is pulled out of the cabinet 10 to its full extension, the shuttle 60 engages the turned-up front stop 58 of the trough 52 and forces it and the attached support system out to a full extension (FIG. 12B). In so doing, the front axis 32, which is now couched in point B of the shuttle cutout 62, continues along the extended transversal centerline outside the cabinet. In the return movement the front axis 32 retraces the centerline inasmuch as it now couches itself in Point C of the triangulat cutout 62. This forces the shuttle 60 against the upturned rear stop 56 of the trough 52 which retracts the support system and the shelf simultaneously. Upon reentering the cabinet 10, the curved slot 48 in the baseboard 44 overrides the couching effect of Point C and guides the front axis 32 back to Point A of FIG. 12A at which time the shelf 30 is again fully recessed.

THE SUPPORT SYSTEM

Narrow glide strips 36 of nylon or similar friction reducing material are fastened to the baseboard 44 of the cabinet 10 in such a pattern as to provide more or less equidistant slideable support to the bi-axial shelf 30 while it is recessed in the cabinet (See FIGS. 2 and 5). As the shelf is rotated and moved laterally out of the cabinet 10 to its extended position, a telescoping mechanism 64 (FIGS. 13 and 16) also moves out from under the baseboard 44 and provides support and guidance to the front half of the shelf 30. As the shelf 30 returns to its recessed position so does the support mechanism.

Figure 4:
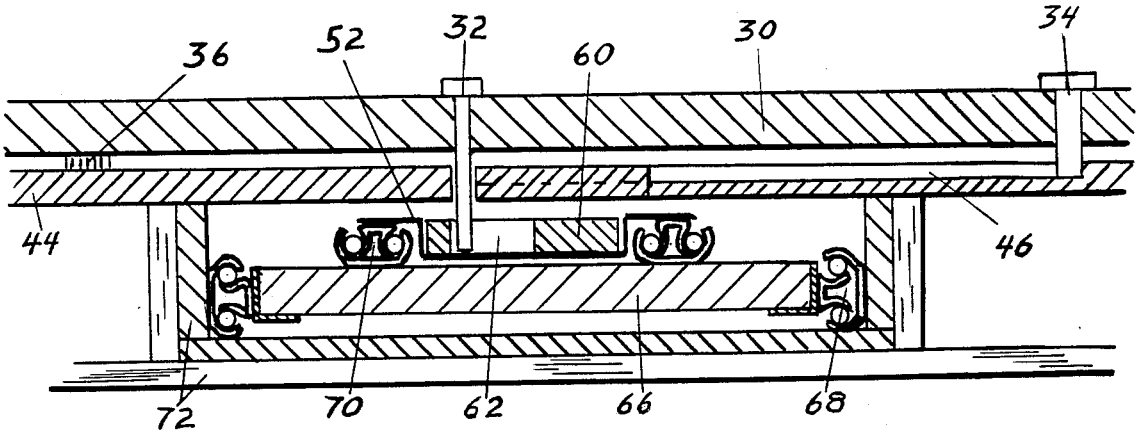
FIG. 4: Vertical cross-section of shelf and its guide and support system along the longitudinal centerline of the cabinet.

The overall support mechanism 64 is a compound system consisting of a movable platform 66 with telescoping sidemount metal slides 68 that make possible an approximate two-thirds extension of the platform 66 from the cabinet 10 (See FIGS. 4 and 13). On top of said platform 66 is fastened a pair of bottom-mount metal slides 70, complete with trough 52 and shuttle 60, which provide another appoximate two-thirds extension for the tip-end shelf supports 38 fastened to them. Assembled within a wooden frame 72, this combined mechanism 64 forms a cartridge that can be fastened to the cabinet 10 underneath the baseboard 44 and behind the panel 71 (See FIG. 1). It should be noted that slides similar to those illustrated here are readily available at hardware and building supply stores nationwide.

Figure 16:
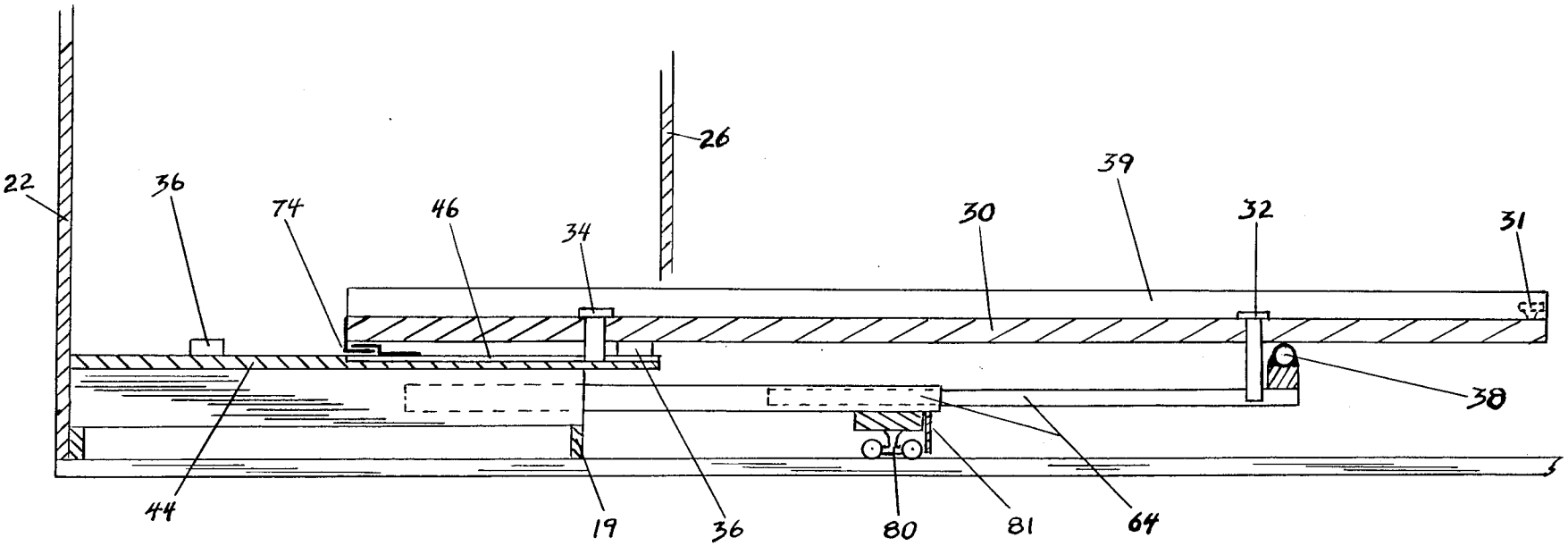
FIG. 16: Side view of extended shelf and support system.

This double telescoping mechanism 64 is sufficient in itself to provide suitable support for the bi-axial shelf 30 under normal household usage. But its load support factor is nearly doubled by the addition of an anchoring device 74 (See FIGS. 5 and 16). This consists of a small L-shaped metal hook 76 fastened to the extreme rear bottom end of the shelf 30 which engages a fixed metal crosspiece 78 on the baseboard 44 when the shelf 30 has been fully extended (FIGS. 2, 5, 14 and 16). The combination of hook 76 and crosspiece 78 anchors the rear end of the shelf and prevents it from tilting upwards when the front end would otherwise tilt downward under a heavy load. This two-piece anchor 74 also serves as a stop to prevent the shelf 30 from being pulled out too far.

Where heavier weights or larger cabinets are involved, a set of dolly-type wheels 80 is attached to the underside of the movable platform 66 just inside the toe-kick 19 of the cabinet 10 so that the wheels 80 rest on the floor. As the mechanism 64 and the shelf 30 are extended, these dolly wheels 80 roll out along the floor and provide absolutely steady support to two-thirds the extended mechanism 64 (FIG. 16). This greatly reduces the length of the cantilevered span supporting the extended sheft 30 and greatly increases its overall weight-carrying capacity. When the shelf 30 and the support mechanism 64 are retracted, the dolly wheels 80 are recessed unseen just inside a panel 81 of the toe-kick 19.

The above-described combination of double telescoping mechanism 64, anchor 74, and dolly wheels 80, all of which function unseen beneath the baseboard 44 and the extended shelf 30, is so effective it will support the shelf 30 in a firm horizontal position under weights of up to one hundred pounds with no apparent deviation from the horizontal.

Figure 17:
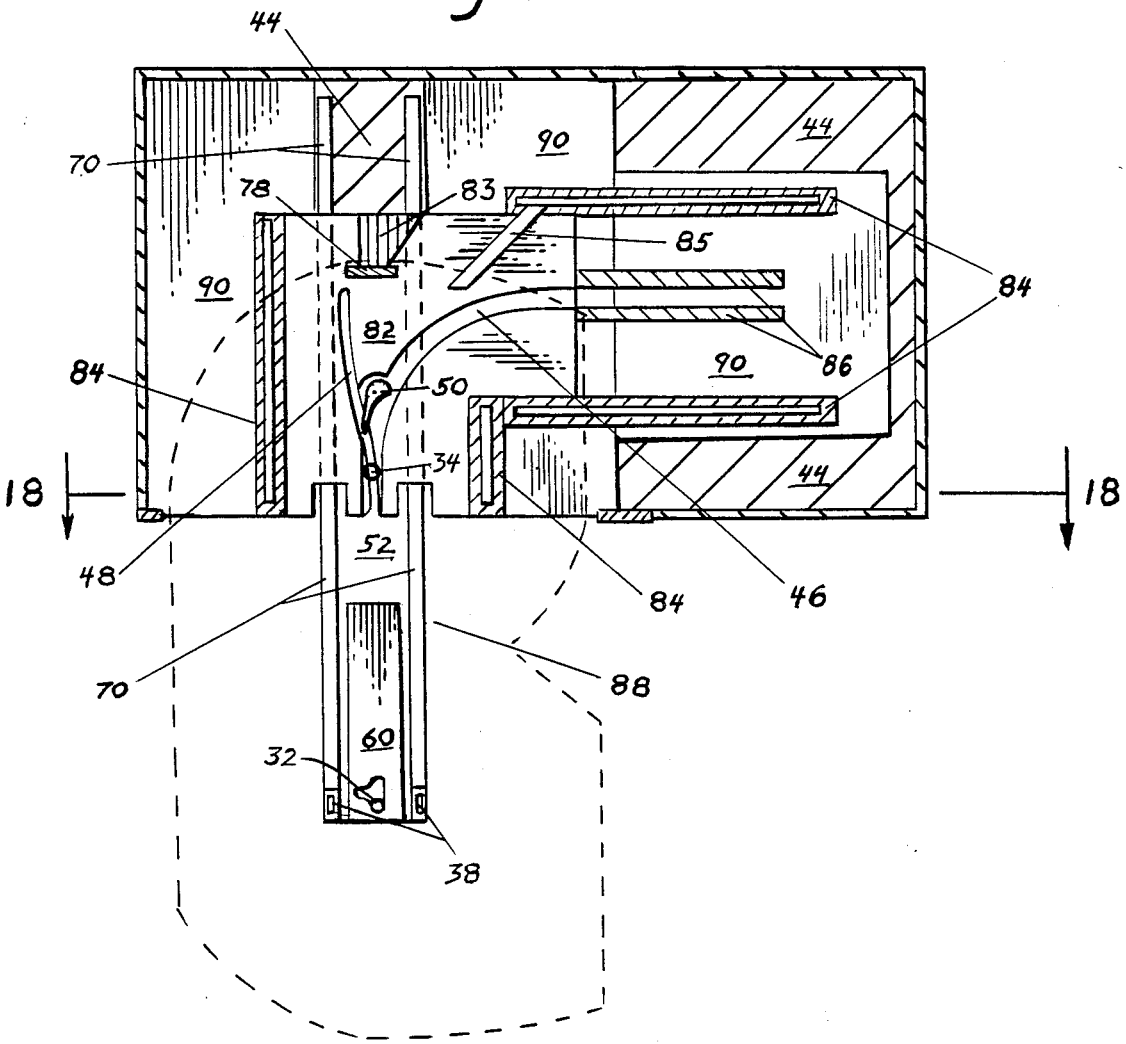
FIG. 17: Top view of single slide system mounted above the baseboard.

A modification of the "below the baseboard installation" as described above is to remove a central section of that baseboard 44 and to install therein a telescoping support mechanism 64 or cartridge so that the topmost moving parts are just slightly less than flush with the top of the adjoining baseboard 44. A guide plate 82 (FIG. 15), which is wide enough to straddle the opening, is then positioned over the cartridge 64 in alignment with both the longitudinal and transversal centerlines. Pre-assembled glide strips 84, which are slightly thicker in combination than the thickness of the guide plate 82, and a diagonal strip 85, are then added on top of the baseboard 44 and the guide plate 82 as needed (FIG. 17). Also, pre-assembled groove guides 86 are fastened endwise against the guide plate 82 to form a matching channel to continue the groove 46 in which the rear axis 34 operates. Such an installation will require not more than $\frac{5}{8}$ inch of vertical space above the baseboard 44, and will be more easy to install in some cabinets.

Figure 18:
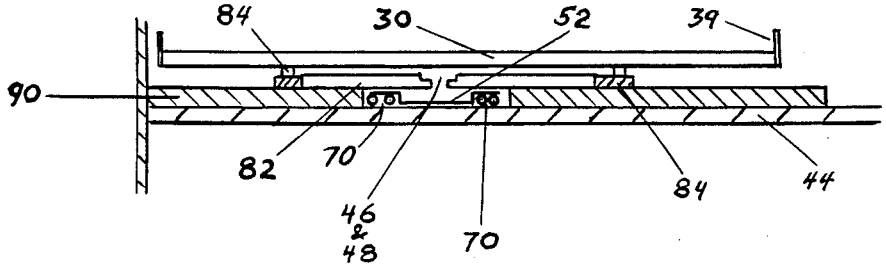
FIG. 18: Frontal cross-section of system as mounted on top of cabinet baseboard.

A similar modification for shelves in smaller cabinets (FIG. 17) is one in which a more simple support mechanism 88, consisting of a single pair of bottom-mount drawer slides 70, assembled complete with trough 52, shuttle 60, and extended shelf supports 38, is fastened on top of the existing baseboard 44 of the cabinet 10 so that the centerlines of the trough 52 and shuttle 60 are aligned with the transversal centerline of the cabinet and its door. Using particle board or plywood as a frame for the support mechanism 88 and as filler material to form a secondary base 90 slightly higher than the support mechanism 88, a fully assembled guide plate 82 is then positioned on this secondary base 90 over the mechanism 88 so that its groove 46 and slot 48 are in alignment with the longitudinal and transversal centerline of the cabinet. The addition of glide strips 84, a diagonal strip 85 and groove guides 86 provide an assembly that requires less than $1\frac{1}{2}$ inch of vertical space above the regular baseboard 44 (FIG. 18). This is a system that can be installed easily by most do-it-yourself home owners.

While the invention has been described above in the prefaced embodiments, many other forms consistent with the invention are possible. For example, the shelf produced by the procedure as detailed will apply to any blind corner-type cabinet, and in so doing will provide the maximum storage area that can be moved in and out of any given cabinet. Furthermore, the use of this shelf and its guidance and support system is not restricted to corner base cabinets only, but also other cabinets such as furniture, cupboards, pantries, liquor cabinets, sink and cabinet combinations, under the counter freezers, display cabinets and other similar closures. Motorized movement of the shelf may be provided.

The rear axis may consist of a rod protruding through the thickness of the shelf or of a disc attached to the underside of the shelf, or as a flat rimmed wheel or a wheel with a convex or concave V-shaped rim to match complementary shaped sides of the groove 34, or as a wheel or disc axle is narrow enough to permit an overhanging edge on each side of the groove which will tend to prevent the rear end of the shelf from tilting upwards when the front end is heavily loaded. The extension of the groove for the rear axis into the blind part of the cabinet may be eliminated by the use of guides on the front and rear side walls. The groove in the baseboard can be eliminated by having a track or channel installed on the surface of the baseboard, or located where the surface would otherwise be.

Furthermore, the location of the front axis can be varied along the longitudinal centerline provided corresponding changes are made in the slot, or provided the overall length of the shelf is reduced. The use of a traffic control device can be eliminated by modifying the location of either/or both the slot and the groove so the juncture of the two is close to the door opening and voids the need for such a device. The triangular cut-out in the shuttle can be modified so as to be a straight longitudinal cutout, or a slanted one, or as a groove that does not cut all the way through Ball bearings or roller bearings may be substituted for or used to supplement the use of nylon or other friction reducing material. The anchor may be attached anywhere on the underside of the shelf from the rear axis to te extreme end. It is usually more efficient on the rear end.

The foregoing and other variations may be made therein without departing from the spirit and scope of the invention as defined in the appended claims.

I claim:

1. A cabinet, an elongated shelf, and means for guiding and supporting the shelf for movement between recessed and extended positions; said cabinet having end walls, rear wall, floor board, and a front wall shorter than the rear wall to leave an access opening between the front wall and one of the end walls for access to the interior of the cabinet; said shelf shaped so that it provides the maximum surface area that is movable in and out of said cabinet, with said shelf having front and rear spaced axes of unequal length engageable with said means for guiding and supporting the shelf from a recessed position within the cabinet to an extended position outside the cabinet and back to the recessed position; in which said guiding and supporting means comprises the floor board of the cabinet with glide members attached thereto and with a groove routed into the topside thereof to receive said rear axis and a slot cut therethrough at a location spaced from the access opening to receive said front axis, said groove and slot coming together in a juncture to form a common channel extending toward the cabinet access opening, and having a pivotally mounted traffic switch adjacent said juncture of the groove and slot, said traffic switch proper routing the front and rear axes into said slot and groove, respectively as the shelf moves in and out of the cabinet; and in which said guiding and supporting means also comprises a retractable mechanism installed beneath the floor board of the cabinet with tip-end members projecting through and above the front edge of said floor board to support the shelf both in its recessed and extended positions, said mechanism being retractable within the cabinet and extendable out of the cabinet.

2. The combination of claim 1, in which the front axis, when the shelf is in its recessed position, is located at a point on the longitudinal centerline of said shelf a distance from its end of the cabinet equal to one-half the width of the access opening, and in which the rear axis is located at a point on the longitudinal centerline of said shelf that is equidistant from one of the end walls and the rear wall of said cabinet.

3. The combination of claim 2, in which the basic outline of the shelf is obtained by the drawing of working circles wc and wc′ from the front and rear axes, respectively, whose radii r and r′ are equal to the distances to the respective end walls of the cabinet less a clearance allowance to prevent binding; and in which a turning arc, which enables the shelf to make a 90-degree turn as it emerges from the cabinet, is established by extending a tangential line t from the front axis to the lower circumference of the rear working circle wc′, by extending a similar tangential line t′ from the rrear axis to the lower circumference of the front working circle wc and, where the two tangential lines t and t′ cross at point x, to use x as a point from which to draw a turning arc dd′, with said turning arc connecting the two working circles on the front side of the shelf, and in which a tangential line connecting the two working circles on the far side of the shelf completes the perimeter of the basic outline of said shelf.

4. The combination of claim 3, in which areas outside the perimeter of the basic outline are added to flesh out the shelf design to provide the maximum feasible surface area that can be moved in and out of any given blind corner base cabinet, such additional areas being bounded by lines connecting points $a^1$, $a^2$, and $a^3$, by points a, b, c, and d, and by points e, f, and g; and in which, for those cabinets whose access opening is less in width than the inside depth of said cabinet, the rear working circle wc′ is truncated equally on both its front and back sides so that its width is the same as the diameter of the front working circle wc and thus can be moved through the access opening.

5. The combination of claim 1, in which said front and rear axes are unequal in diameter and protrude from the underside of the shelf and which move freely in said slot and groove cut in the floor board to control movements of the front and rear halves of the shelf, respectively; in which the rear axis controls its half of the shelf as it moves back and forth in the groove within the confines of the cabinet, and in which the front axis controls the front half of the shelf as it protrudes through the slot in the floor board to engage the underlying retractable mechanism to draw it forth for guidance and support when the shelf is pulled from the confines of the cabinet to its full extension and to retact said mechanism when the shelf is recessed within the cabinet.

6. The combination of claim 1, in which said groove is routed into the top of the floor board beginning at a point on the longitudinal centerline that corresponds to the location of the rear axis when the shelf is in its recessed position, with said groove following that centerline until it reaches the front half of the cabinet where it begins a 90-degree curve to the transversal centerline of the access opening; and in which said slot is cut through the floor board from a point on the longitudinal centerline that corresponds to the position of the front axis of the shelf when fully recessed, with the slot continuing towards the access opening of the cabinet in a gradual arc if there is a door stile, and in a straight line if there is no stile, until said slot intersects the afore mentioned groove after which both slot and groove follow the transversal centerline to the access opening of the cabinet.

7. The combination of claim 6, in which said pivotally mounted traffic switch adjacent the juncture of the groove and slot is moved into a position by the outward bound rear axis whereby an elongated tail of said switch closes a gap in the outer wall of the groove at the point of said juncture and thereby provides a smooth, non-jarring passage for the rear axis in both its outbound and inbound movements in the groove, and in which a large end of the traffic switch is pressed to one side by the inbound rear axis at the point of juncture, which action moves the elongated tail and clears the slot for both the inbound and outbound movements of the front axis, and this sequence occurs each time the shelf is extended from and recessed back into the cabinet.

8. The combination of claim 1, in which the downward protruding front axis of the shelf engages a shuttle that slides back and forth in a trough that is attached to the underlying retractable mechanism, said shuttle and trough being in alignment with the transversal centerline of the cabinet, and said front axis engaging a cut-out in the shuttle so that the shuttle remains in alignment with the said centerline as the shelf is moved out to full extension and returned again to the cabinet.

9. The combination of claim 8, in which additional extension to that provided by the retractable mechanism is needed to achieve full extension of the shelf from the cabinet, and in which this additional extension is provided by use of said shuttle movable in said trough that is attached between a pair of bottom mount slides that support the shelf when it is extended, and in which the trough, which usually is the same length as the slides, and which moves as they move, provides a shallow channel with perpendicular sides and with perpendicular stops at both ends in which said shuttle, which usually is about half the length of the trough, slides back and forth, with the distance between the front end of the shuttle and the front stop of the trough being the additional extension the shelf gains as it is pulled out of the cabinet and over the tip-end supports.

10. The combination of claim 1, in which said pair of tip-end supports are fastened to front ends of a pair of bottom mount slides, said tip end supports protruding upward through notches cut in the front edge of the floor board to a point where they provide support for the front half of the shelf when said shelf is in either the recessed or extended position; and in which the front axis of said shelf protrudes down through said slot in the floor board to engage a cut-out in a shuttle of the retractable mechanism to pull forth or retract the said mechanism as the shelf is either extended or recessed.

11. The combination of claim 1, in which an anchoring hook is fastened to the rear bottom of the shelf which, when the shelf is fully extended, engages a fixed metal crosspiece fastened to the floor board of the cabinet to provide a cantilevered effect which prevents the rear end of the shelf from tilting upwards when the front end would otherwise tilt downward under a heavy load; and in which said glide strips that are attached to the floor board to provide equidistant slideable support for the shelf also are so positioned that they provide an unobstructed lateral and vertical passageway for the anchoring hook which moves in a great arc when the shelf to which said hook is fastened moves laterally and rotates 90-degrees as it is drawn from the cabinet to that point where said hook engages the crosspiece.

12. The combination of claim 1, in which the retractable mechanism is attached flush with the top of the floor board of certain cabinets but underneath a guide plate with a supporting framework which serves as a true floor board in all respects with glide strips, groove and slot, anchor, and cut-outs for the tip-end members of the retractable mechanism to project through to support the shelf in both its recessed and extended positions, said mechanism being retractable within and extendable out of the cabinet.

13. The combination of claim 1, in which the retractable mechanism, which includes a trough and a shuttle, also includes one of a single pair of bottom-mount slides, or one pair each of both the bottom-mount and side-mount slides, depending on the size of the cabinet or the length of extension required.

14. The combination of claim 1, in which a set of wheels are attached to the underside of the retractable mechanism behind a movable panel in a toe kick of the cabinet to provide direct support for a heavily loaded shelf when extended.

* * * * *